US009034443B2

(12) United States Patent
Trani et al.

(10) Patent No.: US 9,034,443 B2
(45) **Date of Patent: *May 19, 2015**

(54) CONTAINER COMPOSED OF A MULTILAYER PAPER MATERIAL AND METHOD FOR OBTAINING SUCH A CONTAINER

(75) Inventors: Giorgio Trani, Venice (IT); Marion Sterner, Venice (IT); Leonardo Andreotti, Ferrara (IT); Marco Scatto, Mirano (IT)

(73) Assignee: Giorgio Trani, Venice (IT)

( * ) Notice: Subject to any disclaimer, the term of this patent is extended or adjusted under 35 U.S.C. 154(b) by 466 days.

This patent is subject to a terminal disclaimer.

(21) Appl. No.: 13/454,813

(22) Filed: Apr. 24, 2012

(65) Prior Publication Data

US 2012/0205429 A1 Aug. 16, 2012

Related U.S. Application Data

(63) Continuation-in-part of application No. 12/866,190, filed as application No. PCT/IB2009/000271 on Feb. 3, 2009, now Pat. No. 8,518,522.

(30) Foreign Application Priority Data

Feb. 14, 2008 (IT) ..... VE2008A0011

(51) Int. Cl.

| | |
|---|---|
| ***B32B 3/28*** | (2006.01) |
| ***B32B 27/10*** | (2006.01) |
| ***B32B 1/00*** | (2006.01) |
| ***B29D 22/00*** | (2006.01) |
| ***B65D 85/78*** | (2006.01) |
| ***B65D 77/08*** | (2006.01) |

(52) U.S. Cl.

CPC ..... *B65D 85/78* (2013.01); *B65D 77/08* (2013.01)

(58) Field of Classification Search

CPC ..... B29D 22/00; B32B 1/00; B32B 1/02; B32B 3/00; B32B 3/28; B32B 27/10; B32B 29/08; B32B 29/00; B32B 2439/00; B32B 2439/02; B32B 2439/40; B32B 2439/62; D21H 27/10; D21H 27/40; D21H 27/30; B31F 1/07; B31F 2201/0717; B65D 65/403; B65D 65/406; B65D 65/38

USPC ..... 428/34.2, 166, 178, 179, 181, 182, 183, 428/184, 186, 153, 154; 229/116.1, 922, 229/939

See application file for complete search history.

(56) References Cited

U.S. PATENT DOCUMENTS

| | | | | |
|---|---|---|---|---|
| 7,451,874 | B2 * | 11/2008 | Kleinsmith | 206/494 |
| 8,518,522 | B2 * | 8/2013 | Trani et al. | 428/179 |
| 2004/0076798 | A1 * | 4/2004 | Larsson et al. | 428/153 |

* cited by examiner

*Primary Examiner* — Catherine A Simone
(74) *Attorney, Agent, or Firm* — Themis Law

(57) ABSTRACT

A multilayer papery material container includes at least one first sheet of a three-dimensional structure and at least one second sheet fixed to the first sheet and defining empty spaces therewith, wherein at least the second sheet is made of a papery material having a degree of extensibility of not less than 5% in all directions, and wherein the container includes a lateral wall provided with a relief motif.

6 Claims, 4 Drawing Sheets

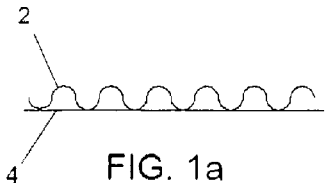
FIG. 1a
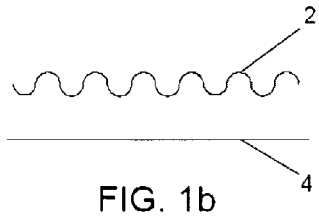
FIG. 1b
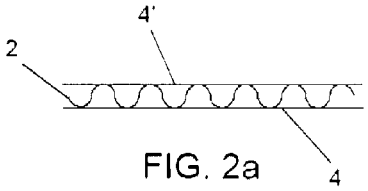
FIG. 2a
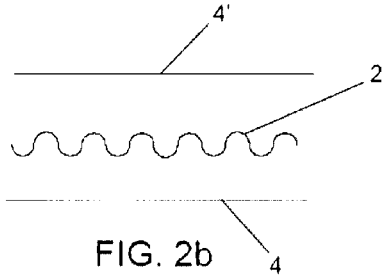
FIG. 2b
FIG. 3
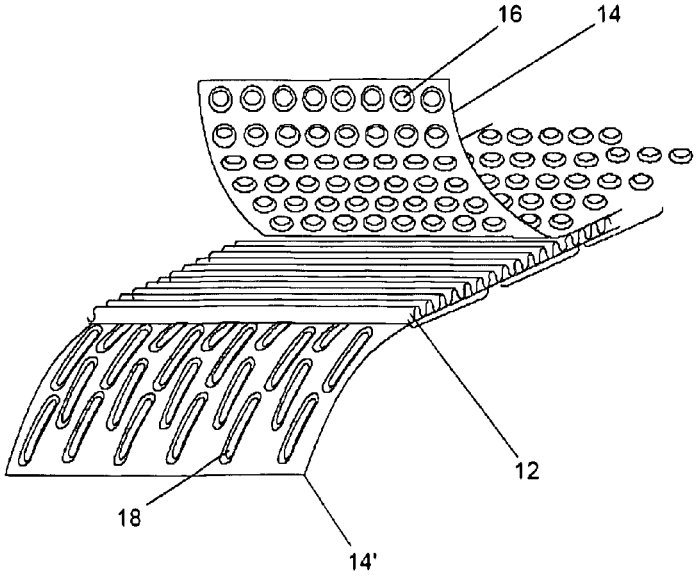

CONTAINER COMPOSED OF A MULTILAYER PAPER MATERIAL AND METHOD FOR OBTAINING SUCH A CONTAINER

CROSS-REFERENCE TO RELATED APPLICATIONS

The present application is a continuation-in-part of U.S. application Ser. No. 12/866,190 having a filing date of Aug. 4, 2010, which is the national stage application of international application No. PCT/IB2009/000271 having a filing date of Feb. 13, 2009, which claims priority to Italian patent application No. VE2008A000011 having a filing date of Feb. 14, 2008, the entireties of which are hereby incorporated by reference.

FIELD OF THE INVENTION

The present invention relates to a multilayer papery material, a method for its preparation, and a method for producing three-dimensional containers.

BACKGROUND OF THE INVENTION

Multilayer papery materials are known, and in particular so-called "corrugated cardboard", which comprises a sheet of corrugated paper, i.e. shaped to present a continuous succession of waves, and a flat paper sheet glued to the corrugated paper sheet along its crests. Two flat paper sheets can also be glued, one onto each side.

Whether it presents one, two or more flat sheets, the known corrugated cardboard is mainly used in the technical packaging sector, in which the function of the corrugated paper layer is to protect the packaged products, while the function of the flat sheet or sheets is to stiffen the corrugated paper layer and to form a support for printing.

In known methods for producing the corrugated paper layer, the wave crests are always transverse to the machine direction, i.e. perpendicular to the advancement direction of the paper web forming the corrugated layer. Because of this, the known corrugated cardboard has greater rigidity to bending in the transverse direction and lesser rigidity to bending in the longitudinal direction.

In addition to being used for wrapping the most varied products, the known corrugated cardboard is also used to form boxes and containers in general, to hold the articles to be packaged, these not necessarily being the same shape as the container, hence their poor bending rigidity in the longitudinal direction gives rise to the difficulty of producing sufficiently rigid containers.

To reduce this problem, it has previously been proposed to increase the number of corrugated paper layers, hence substantially increasing the weight and cost of the packaging.

SUMMARY OF THE INVENTION

An object of the invention is to provide a multilayer papery material which presents high rigidity to bending in all directions.

Another object of the invention is to provide a multilayer papery material on which, in contrast to traditional corrugated containers, writing can be printed or decorations applied in relief.

These and other objects, which will be apparent from the ensuing description, are attained according to the invention by a multilayer papery material container comprising at least one first sheet of three-dimensional structure and at least one second sheet fixed to the first sheet and defining empty spaces therewith, wherein at least said second sheet is made of papery material having a degree of extensibility of not less than 5% in all directions and said container comprises a lateral wall provided with a relief motif.

BRIEF DESCRIPTION OF THE DRAWING

Some preferred embodiments of the present invention are further clarified hereinafter with reference to the accompanying drawings, in which:

FIG. 1*a* is a schematic section through a papery material according to the invention, FIG. 1*b* shows exploded schematic section of the material of FIG. 1*a*, FIG. 2*a* shows a second embodiment of a papery material according to the invention in schematic section, FIG. 2*b* shows exploded schematic section of the material of FIG. 2*a*, FIG. 3 is a partially opened partial perspective view of a third embodiment of apary material according to the invention.

DETAILED DESCRIPTION OF EMBODIMENTS OF THE INVENTION

Figure 4A:
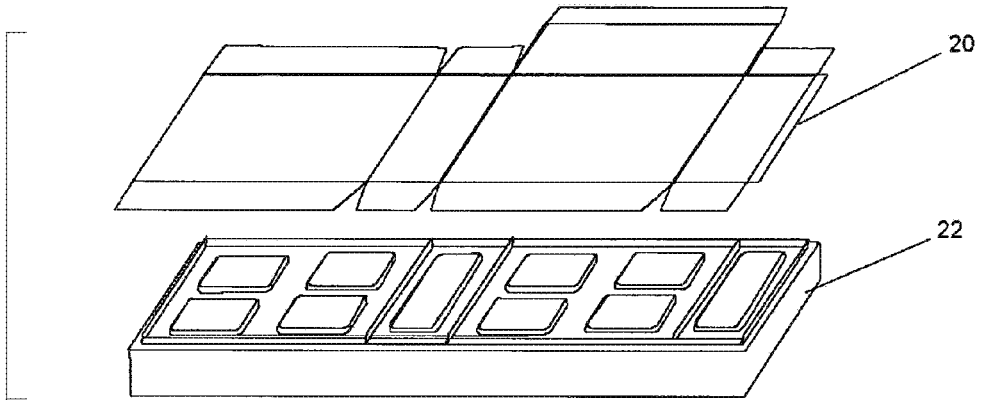
FIG. 4*a* is an exploded perspective view of a punched sheet of multilayer material with which a parallelepiped container is to be formed, together with the flat mold for its deformation by stretch-forming.

As it can be seen from the figures, in the embodiment shown in FIG. 1 the multilayer material of the invention consists of two layers 2, 4 of paper presenting extensibility characteristics of not less than 5% both in a longitudinal and in a transverse direction, and preferably not less than 15%.

Longitudinal direction means that direction along the axis of the continuous paper web leaving the paper machine, while transverse direction means a direction perpendicular to the longitudinal direction.

The first paper layer 2 presents a succession of transverse waves and is produced by traditional corrugated cardboard production methods, i.e. using a corrugator, which bends the continuous web of papery material before gluing onto the second paper layer 4, which is instead maintained taut and acts as a support.

Alternatively, the single paper sheet 4 acting as the support could be made of extensible material while the corrugated paper sheet 2 is instead normal, i.e. is substantially without extensibility properties, except for the intrinsic extensibility typical of each paper sheet.

In the embodiment of FIGS. 2*a* and 2*b*, the multilayer material differs from that shown in FIGS. 1*a* and 1*b* in that the corrugated layer 2 lies between two flat paper layers 4 and 4', both presenting both longitudinal and transverse extensibility characteristics of not less than 5%, and preferably not less than 15%.

Depending on its particular use, the sheet 4 and possibly the sheet 4' can be coupled to further protective layers which need not be papery, but be likewise extensible, to provide the multilayer material with special characteristics, such as impermeability, bondability, printability, etc.

The embodiment shown in FIG. 3 shows three sheet paper layers 12, 14 and 14', of which the intermediate layer 12 is a transversely corrugated paper layer, not necessarily extensible, while the two outer layers 14 and 14' are of extensible paper and before gluing to the intermediate layer 12 are subjected to plastic deformation treatment, which utilizes the extensibility characteristics of the paper to form therein a series of reliefs of different shapes based on the use for which the multilayer papery material is intended.

Specifically, the outer sheet 14 comprises a plurality of circular reliefs 16, the function of which is essentially to increase the anti-impact characteristics which the intermediate layer 12 already provides to the multilayer and which prove particularly useful in using the material in the packaging sector.

The outer sheet 14' presents instead a plurality of rectilinear reliefs 18 disposed perpendicular to the corrugations of the intermediate layer 12 and having the double function of further increasing the anti-impact characteristics of the multilayer material, due to the corrugations of the intermediate layer 12 and to the circular reliefs 16 of the outer layer 14, and of integrating the rigidity to longitudinal bending with the rigidity to transverse bending given by the transverse corrugations of the intermediate layer 12.

It should be noted that while the transverse corrugations of the intermediate layer 12 extend for the entire sheet width and can be produced by corrugation techniques which do not necessarily require the use of extensible paper, the circular reliefs 16 of the layer 14 and the longitudinal reliefs 18 of the layer 14' extend only for part of the width of the relative sheet and are produced by advantageously utilizing the extensibility characteristics of the paper forming the sheet.

From the production viewpoint, the continuous sheets 14 and 14' are subjected, prior to gluing to the intermediate layer 12, to traditional stretch-forming operations achieved for example by passing the extensible paper sheet between pairs of rollers having in their lateral surface mutually penetrating cavities and complementary reliefs, or by other traditional methods comprising deformation by punches, by compressed air, by mixed techniques, etc.

A multilayer papery material according the invention can be advantageously used in the packaging sector for wrapping articles of any type and shape, to assume in this case a shape more or less approximately corresponding to that of the article itself.

The multilayer papery material can also be used to form containers having an actual shape, stable to bending due to the rigidity of the material. This rigidity can also be positively used during the making of the container and during the use of the container when filling. During these stages, which are generally performed by a machine, the multilayer cardboard sheet, possibly punched, folded and glued to form a flattened container, is withdrawn by a traditional automatic packaging machine which, to open it, to position it correctly in front of the filling station and then to close it, subjects the cardboard sheet to a series of stresses of extremely variable type and extent, such that by being made from a substantially indeformable material able to react to every type of stress, the packaging machine can operate thereon under higher performance conditions in terms of rate, reliability and types of stresses.

If however the containers formed from the multilayer papery material of the invention are not to be folded flat while awaiting make-up, to be then opened up, but are already shaped in their final form for use, the invention enables suitable stacking shapes to be developed, which, because the container is indeformable, allow easier stacking and likewise easy destacking.

Finally, according to the invention, the entire multilayer can be deformed, instead of the individual layers, by utilizing the extensibility characteristics of its constituent layers. This can be achieved by subjecting the multilayer web to stretching after its formation, but before the container is made, or on the already made container.

Figure 4B:
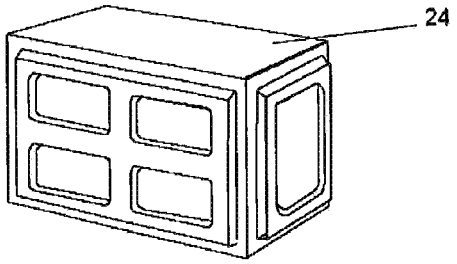
FIG. 4*b* is a perspective view of a container according to the invention.

FIGS. 4*a* and 4*b* show two steps in the method for forming a parallelepiped container obtained from a multilayer papery material according to the invention. In particular, FIG. 4*a* shows upperly a sheet of multilayer material 20 punched and crease-lined, and lowerly a flat mould on which the sheet is deformed by stretch-forming by traditional techniques before being folded and glued to form the parallelepiped container 24 shown in FIG. 4*b*, and with its lateral walls comprising ornamental relief motifs.

Figure 5A:
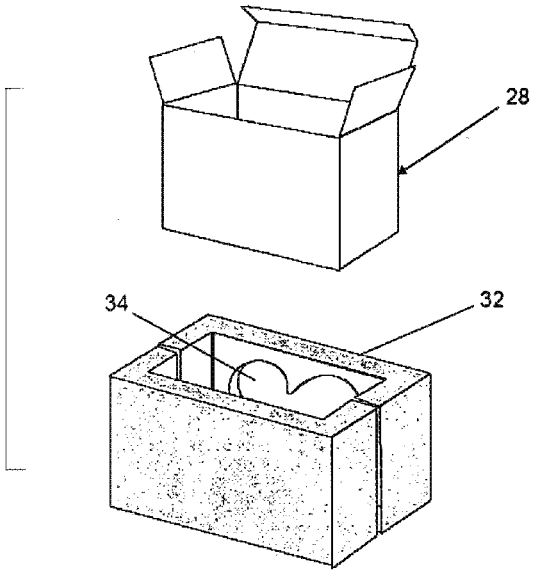
FIG. 5*a* is an exploded perspective view of a parallelepiped container obtained from a multilayer papery material, to be subjected to deformation by stretch-forming within a mold.
Figure 5B:
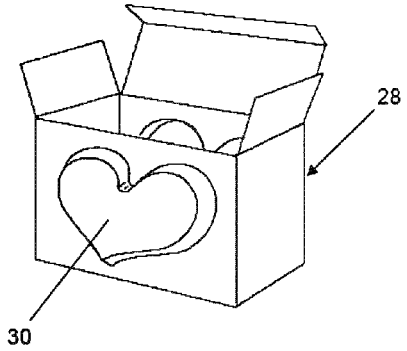
FIG. 5*b* shows the container of FIG. 5*a* in assembled form.

FIGS. 5*a* and 5*b* show two steps of a different method for forming a parallelepiped container having on two opposing vertical walls a different ornamental motif 30. The method comprises firstly forming the parallelepiped container 28 by traditional punching, crease lining, folding and gluing techniques, and then inserting it into the equal-dimensioned parallelepiped cavity of a mold 32, in which the two walls corresponding to the walls of the container 28 to be decorated comprise a depression 34 corresponding to the relief motif 30. Compressed air is then fed into the container 28 inserted in the mould 32, to thrust the wall portions into the mould depressions, to create the ornamental relief motif by stretch-forming.

Figure 6:
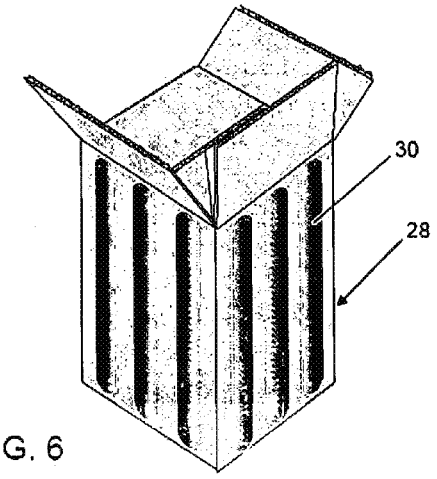
FIG. 6 is a perspective view of a parallelepiped container, also obtained from a papery material according to the invention and presenting on its lateral faces a different ornamental relief motif.
Figure 7:
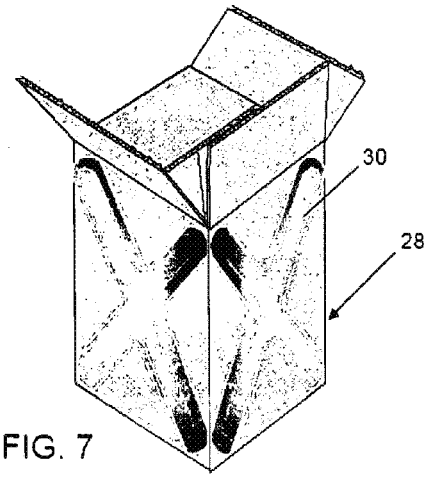
FIG. 7 shows the container of FIG. 6 having a different ornamental relief motif on its lateral faces yet.

By varying the shape and position of the depressions 34 provided in the mold 32, the shape and arrangement of the obtained reliefs 30 on the container vary. FIGS. 6 and 7 show two parallelepiped containers 28 comprising different structural motifs on its lateral walls, to provide a substantially increased rigidity with a smaller quantity of papery material.

The container also has the advantage of a greater containment volume for equal material used, and provides a shock absorption function.

EXAMPLE

Corrugated board using multiple layer paper with one wavy middle layer (fluting) between two flat layers (liner) is commonly used for packaging purposes. Due to the construction of the material, the bending resistance of such a material shows significant differences depending on direction. These differences can cause unwanted effects on the final packaging product. In such cases, the ability to reduce direction-dependent material differences and increase material stiffness would provide meaningful advantages.

A study has been carried out investigating the impact of bending resistance when a corrugated board has been embossed with a relief cavity. Standard corrugated board gives no or very limited embossing opportunities due to the low stretch of the material; hence a stiffness enhancing embossing is not possible without material tear. To allow embossing, a specially designed corrugated board construction has been used where the liner has been changed from a standard Kraft liner to a highly stretchable paper material.

The specification for the corrugated board used in this study is:

Liner: 150 gsm highly stretchable paper (extensible higher than 5% in all directions)

E-fluting: 110 gsm White Kraft liner

Liner: 150 gsm highly stretchable paper (extensible higher than 5% in all directions)

The relief cavity embossed into the board and used in the study had the following shape: length 80 mm (full length of test sample), width 20 mm and depth 3 mm. The specimen for measuring the bending resistance had a width of 100 mm and a length of 80 mm.

Embossing was achieved using the following laboratory method: The cavity was formed by mechanical press forming using a male upper pressing tool with a shape corresponding to the shape of the relief cavity. The corrugated board was placed on a flat compressible rubber material. The male upper tool then applied pressure to the board into the rubber, giving the board a shaped relief pattern.

When comparing the laboratory method with an industrial process there are some differences. The construction of the tools used during the laboratory pressing (male tool against a compressible rubber surface) gives a compression effect on the full surface of the corrugated board. This compression has a negative effect on the board's bending resistance due to the reduction in thickness. In an industrial process, wherein a tool set with a male pressing tool forcing the board into a female cavity is used, the compression effect on the board will not arise and the reduction in bending resistance will not be seen.

After embossing and pressing the corrugated board, the bending resistance of the original corrugated material (1) was compared to an embossed specimen (2) and a non-embossed but pressurised/compressed corrugated board (3).

Figure 8:
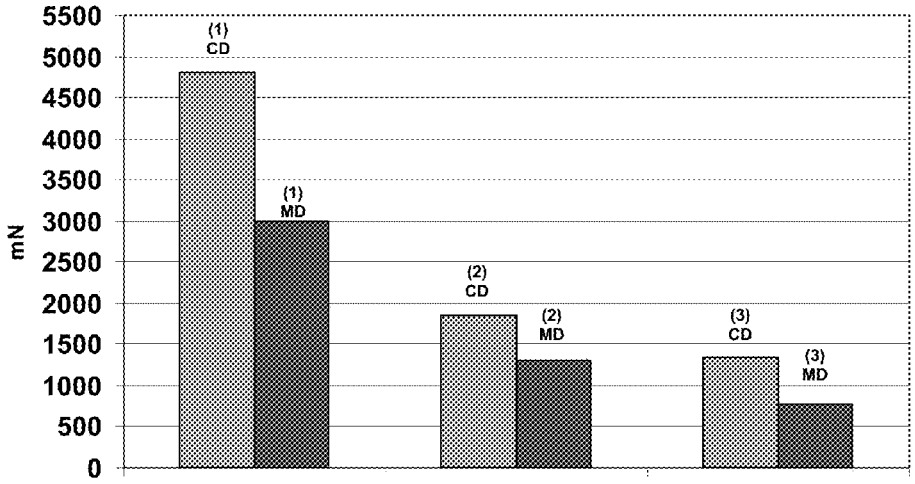
FIG. 8 shows the result of a comparison of the bending resistance of different materials, wherein (1) represents the original material, while (2) represents the embossed material and (3) represents the compressed material.

By comparing (1) and (3) in FIG. 8, the negative effect of the compression in the laboratory equipment can be seen. By comparing (2) and (3) the positive effect of the embossed cavity relief in the material can be seen.

In summary, by making a corrugated board construction where the normally used kraftliner is replaced by a highly stretchable paper, it is possible to emboss the board construction without material breakage. The bending resistance can be increased by embossing a relief cavity into the corrugated board when industrial embossing tools are used. This increase in bending resistance provides advantages in the construction of packages such as boxes to increase package rigidity in critical areas.

In greater detail, the bending resistance in the comparison described above was measured according to the ISO 2493 testing standard with a L&W Bending resistance tester, 15°, 50 mm distance. The standard for specimen dimension is 38 mm×80 mm, while the actual specimens were 100 mm×80 mm in order to be able to produce the embossing with a laboratory device. The specimen were prepared as follows:

1) Original. The original construction was cut to the relevant dimensions.

2) Embossed. The original construction was embossed to a depth of 3 mm and a width of 20 mm.

3) Compressed/Pressurised. The original construction was put under the same pressure as sample (2). The only difference between the samples is that (2) was pressed toward a male while (3) was pressed toward a plain sheet.

The bending resistance was measured in both material directions, i.e., in the cross direction (CD) where the lines of the corrugated pattern are parallel to the direction of the cavity, and in the machine direction (MD) where the direction of the embossed cavity is perpendicular to the corrugated lines.

The comparison showed that the original, non-pressed sheet had the highest bending resistance. The reason why the embossed and the pressurized material showed lower bending resistances is that the pressure put on the material by the test tools (male/flat tool against a flat compressible rubber surface) caused a compression of the corrugated material with a resulting reduction in thickness. This result can be overcome by using an industrial embossing tool setup. When comparing (2) and (3), where both samples were set under pressure but with the addition of an embossed relief cavity to sample (2), the results show that the relief gives an increased bending resistance to the corrugated board in the CD as well as in the MD.

While the invention has been described in connection with the above embodiments, it is not intended to limit the scope of the invention to the particular forms set forth, but on the contrary, it is intended to cover such alternatives, modifications, and equivalents as may be included within the scope of the invention. Further, the scope of the present invention fully encompasses other embodiments that may become apparent to those skilled in the art and the scope of the present invention is limited only by the appended claims.

The invention claimed is:

1. A multilayer papery material container comprising:

at least one first sheet of three-dimensional structure; and at least one second sheet fixed to the first sheet and defining empty spaces therewith, wherein at least said second sheet is made of a papery material having a degree of extensibility of not less than 5% in all directions, wherein said container comprises a lateral wall provided with a relief motif, and wherein the at least one second sheet are two second sheets of extensible papery material, between which said first sheet of three-dimensional structure is interposed.

2. The container according to claim 1, wherein said container has a parallelepiped shape.

3. The container according to claim 1, wherein said container comprises two lateral walls each provided with a relief motif.

4. The container according to claim 1, wherein a layer of a protective material is coupled to at least one of said two second sheets.

5. The container according to claim 1, wherein said first sheet is made of a papery material having a degree of extensibility of not less than 15% in all directions.

6. The container according to claim 1, wherein the three-dimensional structure of the first sheet is a corrugated structure.

* * * * *